United States Patent [19]

Nagao et al.

[11] Patent Number: 4,476,000

[45] Date of Patent: Oct. 9, 1984

[54] METHOD OF MAKING A MAGNETIC FILM TARGET FOR SPUTTERING

[75] Inventors: Makoto Nagao; Akira Nahara; Yoshihiro Arai, all of Asaka, Japan

[73] Assignee: Fuji Photo Film Co., Ltd., Saitama, Japan

[21] Appl. No.: 313,286

[22] Filed: Oct. 21, 1981

[30] Foreign Application Priority Data

Oct. 28, 1980 [JP] Japan ..... 55-151206

[51] Int. Cl.[3] ..... C23C 15/00

[52] U.S. Cl. ..... 204/192 M; 204/192 N; 427/38

[58] Field of Search ..... 204/192 N, 192 M; 427/38, 39, 127, 128, 132

[56] References Cited

U.S. PATENT DOCUMENTS

| | | | |
|---|---|---|---|
| 3,350,180 | 10/1967 | Croll | 29/183.5 |
| 3,856,579 | 12/1974 | Allen | 148/103 |
| 4,002,546 | 1/1977 | Shirahata et al. | 204/192 N |
| 4,112,137 | 9/1978 | Zega | 427/38 |
| 4,354,909 | 10/1982 | Takagi et al. | 204/192 N |

OTHER PUBLICATIONS

E. L. Hollar et al., Composite Film Metallizing for Ceramics, J. Electrochem. Soc., vol. 117, No. 11 (Nov. 1970) pp. 1461–1462.

D. Hadfield, Permanent Magnets and Magnetism, Iliffe Books Ltd, London, 1962, p. 389.

*Primary Examiner*—G. L. Kaplan

*Assistant Examiner*—William T. Leader

*Attorney, Agent, or Firm*—Gerald J. Ferguson, Jr.; Joseph J. Baker

[57] ABSTRACT

A method of making a magnetic film target for use in sputtering characterized by forming a film of a magnetic material on a substrate by ion-plating a raw magnetic material thereon. The raw magnetic material is either identical with the magnetic film material or an ingredient or ingredients for constituting it. In the latter case, one or more metallic ingredients are simultaneously ion-plated in the same system to form a magnetic alloy or compound film on the substrate. To prepare a magnetic alloy target in which the composition changes in the thickness direction, the ion plating ratio of respective metallic ingredients is changed with time.

10 Claims, No Drawings

METHOD OF MAKING A MAGNETIC FILM TARGET FOR SPUTTERING

BACKGROUND OF THE INVENTION

1. Field of the Invention

This invention relates to a method of making a target for sputtering, and more particularly to a method of making a magnetic film target for use in sputtering.

2. Description of the Prior Art

In general, the sputtering method can form denser films than the deposition method. The film formed by the sputtering method shows high adhesion to a substrate. However, the sputtering method is disadvantageous in that the film forming rate is relatively low. For this reason, the method has been used mainly to form films on a laboratory scale for the purpose of testing and research. For film forming on an industrial scale, the method has been used only to a limited extent. Recently, however, there have been developed several types of so-called high speed sputtering methods that can form films at a high speed. Such high speed sputtering methods are now widely used for film forming on an industrial scale.

Among the high speed sputtering methods, the most attractive is generally called "magnetron sputtering". In the magnetron sputtering method, a means for generating a magnetic field, such as permanent magnet and electromagnet, is located to the rear of the target. This magnetic field generating means generates, in the vicinity of the target surface, a magnetic field which intersects perpendicularly to the electric field applied between the target and a substrate holder. This magnetic field confines electrons necessary for gas ionization in the vicinity of the target surface and causes electrons to turn toward the target surface. As a result, electrons move a longer distance and the collision probability of electrons with gas molecules is increased, whereby the gas ionization efficiency is improved. Thus, in the magnetron sputtering method, the gas ionization efficiency is enhanced by applying the magnetic field so as to intersect perpendicularly with the electric field. Therefore, the sputtering efficiency is increased, resulting in a higher film forming rate.

However, magnetron sputtering of this type is disadvantageous in that magnetic materials cannot be used as the target. If a magnetic material is used as the target in the magnetron sputtering method, the lines of magnetic force generated by the magnetic field generating means are not emitted from the target surface but pass inside the target body. In this case, the gas ionization efficiency is identical with that of the ordinary sputtering method using no magnetic field and, accordingly, the film forming rate cannot be improved. To solve this disadvantage of the magnetron sputtering method, it is known to reduce the thickness of the magnetic material target and increase the magnetic reluctance thereof. With this approach, the lines of magnetic force generated by the magnetic field generating means at the rear of the target can go through the target and are emitted from the target surface. Accordingly, a magnetic field can be formed in the vicinity of the target surface. With respect to the thin magnetic material target used in the magnetron sputtering method, a target thickness of 1.5 mm or less has been reported. Such a target is sometimes prepared by plating. However, when the target is prepared in a plating solution, the obtained target contains impurities and, in general, it is impossible to prepare high-quality targets.

However, it is not easy to prepare thin targets having a large area. In general, when preparing a thin magnetic material target, a sheet-shaped slice is first cut off from a large mass of a target material. The sheet-shaped slice obtained is then ground and polished to form a thin film. The film thus formed is thereafter bonded to a substrate (holder) made of a metal such as copper, which serves to cool (water-cool) the film and prevents the film from being distorted. However, this method of preparing a target involves many steps such as slicing off, grinding and polishing the sheet-shaped slices, bonding the formed films to substrates, and the like. Thus this method requires a complicated production process, and the target products become very expensive. Further, in general, film targets obtained by this method show uneven film thickness. In addition, the adhesion strength of films to substrates is so low that the film targets often separate from the substrates and cannot be used any more. Furthermore, it is sometimes necessary to prepare a target having a composition which changes in the thickness direction thereof, instead of an ordinary target in which the composition is the same throughout the target body. However, the above-described conventional method cannot prepare targets in which the composition changes in the thickness direction.

For the reasons described above, there is a need for a method of preparing a magnetic film target for use in the sputtering process, particularly in the magnetron sputtering process, which can eliminate the disadvantages by the above-described conventional method.

SUMMARY OF THE INVENTION

The object of the present invention is to provide a novel method of making a magnetic film target for sputtering, which is improved over the above-described conventional method.

Another object of the present invention is to provide a method of making a magnetic film target for sputtering, which can prepare an inexpensive target in a manner easier than the above-described conventional method.

A further object of the present invention is to provide a method of making a magnetic film target for sputtering, which can prepare a target having more uniform film thickness and a higher adhesion strength to a substrate compared with those obtained by the above-described conventional method.

A still further object of the present invention is to provide a method of making a magnetic film target for sputtering, which can be used to prepare a target of such type having a composition which changes in the thickness direction thereof, such a target not being obtainable with the above-described conventional method.

An even further object of the present invention is to provide a method of making a magnetic film target for sputtering, which can be used to prepare a target of such type having a composition which changes in the width or length direction thereof, such targets not being obtainable with the above-described conventional method.

To accomplish the above-described objects of the present invention, the inventors conducted research toward development of a novel method of making a magnetic film target for sputtering. Through their work they found that the above-described objects can be accomplished if targets are prepared by using the ion plating technique which is known as a method of forming a film.

The method of making a magnetic film target for sputtering in accordance with the present invention is characterized by forming a film of a magnetic material on a substrate by ion-plating a raw magnetic material onto the substrate.

With the method of the present invention, it is possible to prepare magnetic film targets suitable for sputtering, particularly for magnetron sputtering, in much easier and more inexpensive manner than the conventional method. The magnetic film targets obtained by the method of the present invention show more uniform film thickness and a higher adhesion strength to the substrate than those obtainable with the conventional method. Further, in accordance with the method of the present invention, it is possible to obtain magnetic film targets having a composition which changes in the thickness direction thereof. In addition, it is also possible to prepare magnetic film targets having a composition which changes in the width or length direction thereof.

DESCRIPTION OF THE PREFERRED EMBODIMENTS

The method according to the present invention utilizes the known ion plating technique. In accordance with the present invention, a raw magnetic material is evaporated to form a vapor thereof, the formed vapor is ionized, accelerated and moved toward a substrate, the ionized moving vapor is caused to violently impinge upon the substrate to form a film of the magnetic material thereon. As ion plating techniques, there are known various types of processes such as the direct current, high-frequency, cluster ion beam and hot cathode processes, as well as processes based on modifications of these. Any of these known ion plating processes can be utilized in the method of the present invention. Various types of ion plating equipment for carrying out the conventional ion plating processes have been designed and made commercially available. Any of these can be used to conduct the method of the present invention. When performing the method of the present invention, the various conditions necessary for the ion plating will be selected appropriately depending on various factors such as the type of the magnetic material, film forming rate, ionization degree of the vapor of the raw magnetic material and the like. In general, the selected conditions will not deviate from the range generally used in the conventional ion plating processes. The ion plating technique is distinguished by ionizing the vapor of a film forming material. In the method of the present invention, a part or all of the vapor of the raw magnetic material may be ionized similarly to the ordinary ion plating technique.

In the method of the present invention, the raw magnetic material to be ion-plated on the substrate may be the same as the magnetic material ultimately provided on the substrate in the form of a thin film. Alternatively, the raw magnetic material may be an ingredient for constituting the magnetic material ultimately provided on the substrate in the form of a thin film. In this case, the ingredient for constituting the magnetic material may be either magnetic or non-magnetic. Therefore, unless otherwise specified, the term "raw magnetic material" as used herein means both a material identical with the magnetic material ultimately provided on the substrate and an ingredient for constituting the magnetic material ultimately provided on the substrate. Consequently, the method of the present invention is classified into the two methods described below, depending on whether a material the same as that of the magnetic material ultimately provided on the substrate is used as the raw magnetic material or an ingredient for constituting the magnetic material ultimately provided on the substrate is used as the raw magnetic material.

In the first method according to the present invention, the material which is the same as the magnetic material ultimately provided on the substrate is used as the raw magnetic material. The magnetic material is ion-plated onto the substrate to form a thin film thereof on the substrate for use as a target. The first method can be applied to prepare a magnetic film target comprising an elementary metal such as Fe, Co, Ni and Gd, or a magnetic film target comprising an alloy such as Co-Cr, Gd-Fe, Tb-Gd-Fe-Bi and Tb-Co. Such a magnetic film target comprising an elementary metal can be prepared only by this first method.

The second method according to the present invention is somewhat complicated compared with the above-described first method. In the second method, an ingredient for constituting the magnetic material ultimately provided on the substrate is used as the raw magnetic material. The ingredient for constituting the magnetic material may be either magnetic or non-magnetic. The ingredient is ion-plated onto the substrate to form a thin film of the magnetic material containing the ion-plated ingredient on the substrate for use as a target. The second method can be applied to prepare a target of the magnetic material comprising two or more ingredients. The second method can be carried out in two ways as described below, depending on whether the magnetic material is an alloy consisting of two or more metals or is a compound formed by one or more metals and one or more non-metallic ingredients.

The first version of the second method is applied to prepare a magnetic film target comprising an alloy such as Co-Cr, Gd-Fe, Tb-Gd-Fe-Bi and Tb-Co. In this case, all metallic ingredients for constituting the desired alloy magnetic material are simultaneously ion-plated onto the substrate in the same system. In this way, a thin film of the desired alloy magnetic material is formed on the substrate. When carrying out this method, it is possible to change the ion plating ratio of the respective metallic ingredients with time, for example, by altering the evaporation rate thereof with time. In this way, it is possible to obtain a magnetic alloy target in which the composition changes in the thickness direction. Such a magnetic alloy target in which the composition changes in the thickness direction could not be obtained with the conventional method.

The second version of the second method is applied to prepare a magnetic compound target. In this method, one or more metallic ingredients for constituting the desired magnetic compound are ion-plated onto the substrate in an atmosphere containing one or more non-metallic ingredients for constituting the desired magnetic compound. When two or more metallic ingredients are used, all of them are of course ion-plated at the same time in the same system. In this way, a thin film of the desired magnetic compound is formed on the substrate. Namely, in this case, the ion plating of one or more metallic ingredients involves a reaction of the metallic ingredients with one or more non-metallic ingredients existing in the ion-plating atmosphere. This method can be used, for example, to prepare an $Fe_2O_3$ magnetic film target. When preparing such an $Fe_2O_3$ magnetic film target, Fe is ion-plated in an oxygen atmosphere to form an $Fe_2O_3$ film on the substrate.

The magnetic film targets prepared in accordance with the method of the present invention must be thin enough to prevent problems from occurring when they are used as targets in magnetron sputtering. However, from the standpoint of the working life of the targets, it is preferable that the targets be as thick as possible. In general, the thickness of the magnetic film targets prepared by the method of the present invention will be appropriately selected from the range of 50 μm to 1 mm, considering the application and the working life required, mainly in the magnetron sputtering process.

In the method according to the present invention, any of the substrates used in the conventional sputtering targets may be used as the substrates for forming the magnetic film targets. Generally, substrates made of metals such as copper will be used. The substrates may be of a special construction for the purpose of improving the cooling effect during sputtering.

The method of the present invention can be used to prepare thin magnetic targets simply by ion plating the raw magnetic material or materials onto substrates. Accordingly, with the method of the present invention, it is possible to prepare magnetic film targets for sputtering in much easier and more inexpensive manner than possible with the conventional method. In addition, the magnetic film targets obtained by the ion plating method according to the present invention show remarkably uniform thickness compared with the conventional magnetic film targets obtained by grinding and polishing a sheet-shaped magnetic material. Further, the magnetic film targets obtained by the ion plating method according to the present invention show stronger adhesion to substrates than in the magnetic film targets obtainable with the conventional method. Therefore, the targets prepared according to the present invention do not peel off or separate from their substrates. Furthermore, as described above, the method according to the present invention can be used to prepare magnetic alloy film targets of such type in which the composition changes in the thickness direction, such a target not being obtainable with the conventional method. Moreover, with the method according to the present invention, it is possible to prepare extremely thin magnetic film targets such as could not practically be obtained by the conventional method.

As described above, the method of making a magnetic film targets for sputtering according to the present invention has various advantages over the conventional method of preparing such magnetic film targets. Accordingly, the method of the present invention is very useful in the industrial applications and will no doubt replace the conventional method.

The present invention will further be described by the following examples.

EXAMPLE 1

Using the high-frequency process, Fe (raw magnetic material) was ion-plated onto a circular copper substrate having a diameter of 17 cm and a thickness of 2 cm. In this way, a circular Fe magnetic film target having a diameter of 17 cm and a thickness of approximately 100 μm was formed on the substrate. The ion plating was carried out using an ordinary ion plating equipment consisting of a combination of a bell jar type vacuum deposition unit and a 13.56 MHz high-frequency power supply. The ion plating was effected under the following conditions:

Initial vacuum: $5\times10^{-4}$ mmHg
High-frequency power: 300 W
Acceleration voltage: −400 V
Film forming rate: 10 μm/hour
Film forming time: 10 hours The obtained target showed an extremely uniform thickness and a sufficiently high adhesion strength to the substrate, so that the target did not separate from the substrate. This target could effectively be used for magnetron sputtering.

EXAMPLE 2

The interior of a bell jar was evacuated to a vacuum of $5\times10^{-6}$ mmHg. Then, Fe and Gd were evaporated simultaneously from two positions using two electron beam guns. The evaporated particles were ionized by applying voltages to the thermal filament and the ionization electrode, thereby forming a 50 μm-thick Gd-Fe layer on a copper plate. At this time, the evaporation rates of Fe and Gd were changed periodically. In this way, a film target in which the composition ratio of Gd to Fe changed periodically (at intervals of about 200Å) by about 1% around 23% Gd in the thickness direction of the film target was prepared.

Thereafter, sputtering was effected using the so obtained target, and thus a photomagnetic recording medium was prepared. When information was written on the photomagnetic recording medium by using minute spots, a thermally stable record was obtained.

We claim:

1. A sputtering method comprising the steps of:
providing a magnetic film sputtering target characterized by forming a film of a magnetic material on a target substrate by ion-plating at least one of a plurality of raw magnetic materials onto said substrate;
establishing electric and magnetic fields adjacent a sputtering surface of said target where said fields are substantially perpendicular to one another and where a portion of said magnetic field extends through said sputtering target, said electric and magnetic fields confining plasma adjacent the sputtering surface of the target to effect sputtering thereof; and
coating a further substrate with the sputtered target material.

2. A method as defined in claim 1 wherein said one raw magnetic material is the same as said magnetic material.

3. A method as defined in claim 2 wherein said one raw magnetic material is an elementary metal magnetic material.

4. A method as defined in claim 2 wherein said plurality of raw magnetic materials comprises an alloy magnetic material.

5. A method as defined in claim 1 wherein said one raw magnetic material is an ingredient for constituting said magnetic material.

6. A method as defined in claim 5 wherein said magnetic material is an alloy magnetic material, and all metallic ingredients for constituting said alloy magnetic material are respectively used as said plurality of raw magnetic materials and simultaneously ion-plated in the same system onto the substrate.

7. A method as defined in claim 6 wherein the ion plating ratio of the respective metallic ingredients is changed with time so as to form a film of the alloy magnetic material in which the film composition changes in the thickness direction.

8. A method as defined in claim 5 wherein said magnetic material is a compound magnetic material formed by a reaction of one or more metallic ingredients with one or more non-metallic ingredients, and said one or more metallic ingredients are respectively used as said plurality of raw magnetic materials and ion-plated onto the substrate in an atmosphere containing said one or more non-metallic ingredients, provided that, if two or more metallic ingredients are used, all of said metallic ingredients are simultaneously ion-plated in the same system.

9. A method as defined in claim 8 wherein said magnetic material is $Fe_2O_3$, and Fe is ion-plated as said one raw magnetic material in an oxygen atmosphere.

10. A method as defined in claim 9 wherein the thickness of said film is from 50 μm to 1 mm.

* * * * *